United States Patent [19]

Keller

[11] 4,129,973

[45] Dec. 19, 1978

[54] JOINING CLAMP ASSEMBLY WITH OVERLAPPING SEALS FOR TRANSLUCENT WALL PANELS AND THE LIKE

[75] Inventor: Richard R. Keller, Bedford, N.H.

[73] Assignee: Kalwall Corporation, Manchester, N.H.

[21] Appl. No.: 793,522

[22] Filed: May 4, 1977

[51] Int. Cl.[2] ..... E04B 7/00; E04D 1/16; E04D 3/38

[52] U.S. Cl. ..... 52/308; 52/394; 52/519; 52/552; 52/553; 52/584

[58] Field of Search ..... 52/308, 307, 394, 556, 52/519, 543, 553, 552, 306, 466, 584, 222, 273

[56] References Cited

U.S. PATENT DOCUMENTS

| | | | |
|---|---|---|---|
| 2,962,133 | 11/1960 | Kivott et al. | 52/584 X |
| 3,082,849 | 3/1963 | Keller | 52/466 X |
| 3,363,381 | 1/1968 | Forrest | 52/584 X |
| 3,555,755 | 1/1971 | Reed | 52/394 X |
| 3,943,674 | 3/1976 | Ray | 52/584 X |

FOREIGN PATENT DOCUMENTS

| | | | |
|---|---|---|---|
| 662021 | 7/1935 | Fed. Rep. of Germany | 52/584 |
| 686227 | 7/1930 | France | 52/394 |
| 916838 | 12/1946 | France | 52/584 |
| 856841 | 12/1960 | United Kingdom | 52/584 |

*Primary Examiner*—Leslie Braun

*Attorney, Agent, or Firm*—Rines and Rines, Shapiro and Shapiro

[57] ABSTRACT

This disclosure deals with novel clamping structures for stagger-joining wall panels as of the translucent sandwich type and the like, provided with panel overlapping clamping elements having weather sealants and adapted to be threadedly locked in offset position.

4 Claims, 1 Drawing Figure

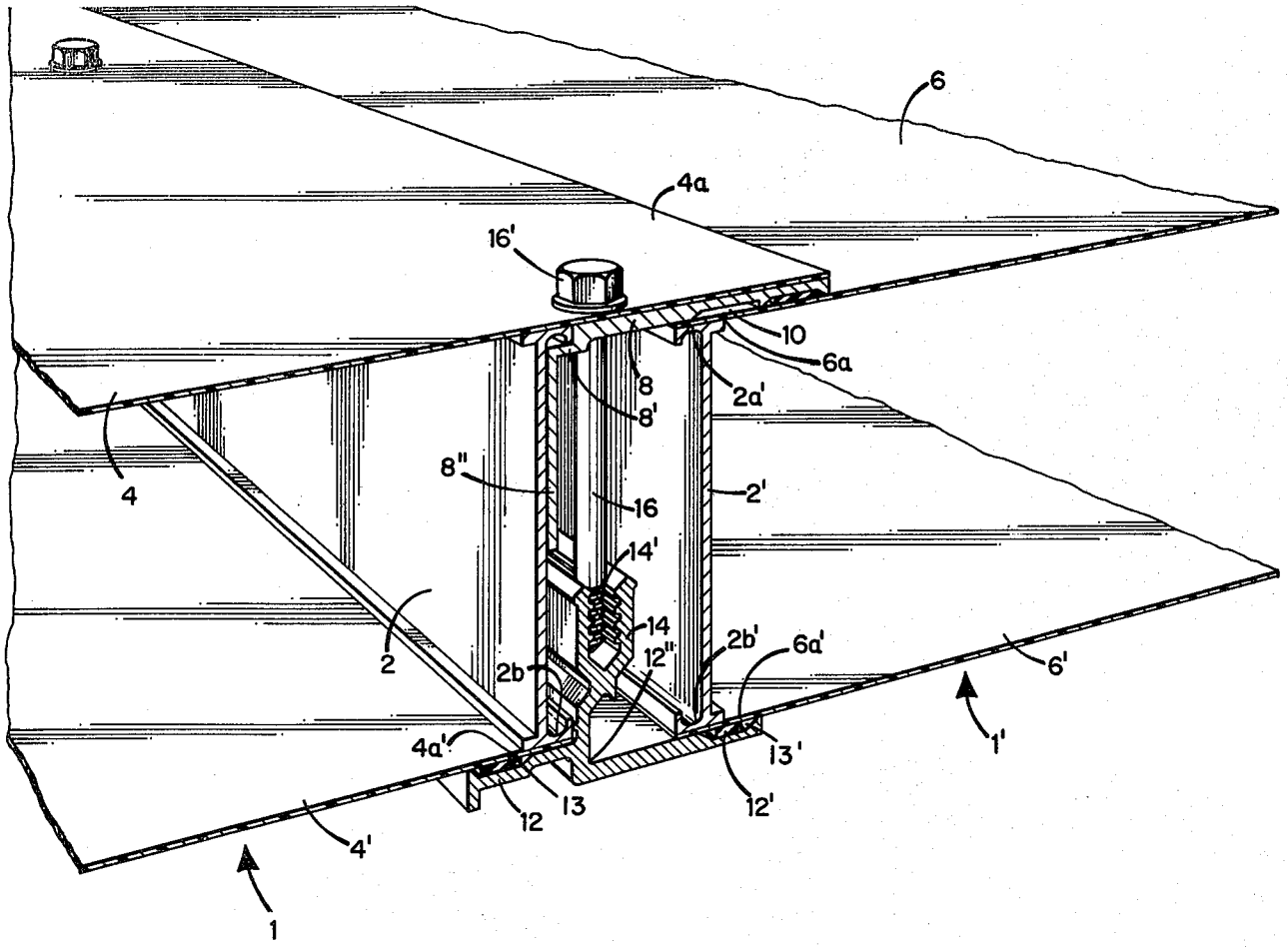
6
4a
16'
10
6a
2a'
8
8'
8"
2'
16
14'
14
12"
2b
2
4
6'
1'
6a'
2b'
13'
12'
13
12
4a'
4'
1

JOINING CLAMP ASSEMBLY WITH OVERLAPPING SEALS FOR TRANSLUCENT WALL PANELS AND THE LIKE

The present invention relates to joining assemblies for wall panels and the like, being more particlularly directed to the clamp securing together of successive panels, such as translucent wall sections, with an overlapping connection adapted for sealing from the weather.

Light diffusing structural panels, as of the type disclosed in U.S. Pat. No. 2,931,468, when used, for example, as exterior curtain walls for buildings, have been joined by a batten system, typically illustrated by and described in U.S. Pat. No. 3,082,849. Although various embodiments of this joining system have been successfully employed with most forms of translucent, sandwich type curtain walls, in many such cases the conjoined adjacent panels were rigidly held in position by the forcible comression of batten components against the juxtaposed interior and exterior panel edge portions, usually including an interposed layer of resinous sealant between opposed surfaces of the batten and panel in an attempt to maintain weather integrity. Such an arrangement in certain applications, however, results in certain disadvantages materially affecting the desired weather integrity of the panel joints, in that cyclic temperature variations influence the expansion and contraction of such a joint assembly, often times resulting in random ruptures of the sealant, leading to a breakdown of the joint integrity. While sealants which maintain elastic properties even in severe temperature extremes have helped this problem somewhat, such prior art batten systems have too frequently been unable to achieve a uniform compression along the batten structure for a period of years, and thus have been subject to rupture of sealant, with the attendant problems of losing weather integrity.

To obviate this problem, appropriate structural channels have been constructed on alternate sides of opposed adjoining panel edges for maintaining a prescribed non-sliding spatial relation between abutting panel edges and into which sealant can be evenly distributed and maintained within the joint assembly, as disclosed in U.S. Pat. No. 3,555,755. This panel edge design provided an integral overlay surface which extends for a short distance beyond the joint and over the adjoining panel somewhat as a shingle or lap as a further measure of joint protection. By placing this joint structure along the edge portion intermediate the panel surfaces, thereby eliminating the before-mentioned exposed batten system, translucent wall panel buildings could be erected in areas of corrosive environments which were theretofore closed to building techniques employing exposed metallic batten members as of, for example, aluminum.

Such joint assemblies, moreover, were thus adapted to be employed with equal confidence on horizontally inclined surfaces and vertical surfaces, with assurance that the joint structure would maintain its weather integrity under virtually all circumstances for a period of years. Additionally, the overlap characteristic of this joint assembly eliminated dam effects that might otherwise result should these panels be employed as a roof structure.

While such structures have been found to provide improved results in many applications, there are circumstances where the inflexibility of such integral joining members becomes evident. Though panels of elements having substantially the same thermal expansion and contraction coefficients lend themselves to such abuttment and overlap joints with the substructures similarly moving together as a unit, these are not satisfactory where materials of different thermal expansion coefficients are employed, as with cladded substructures of steel, concrete, wood, etc. Such different thermal linear expansion substructures, indeed, can produce buckling that, despite the overlap construction, can generate leaks.

Underlying the present invention, accordingly, is the discovery that, by providing a space at the panel junctions within rather radically redesigned joining channels forming a non-integral clamp structure, expansion and contraction movement can be confined internally within the space of the clamp, enabling give in multidirections, but with the overlap structure capable of resisting leak-developing buckling.

An object of the invention, thus, is to provide a new and improved joining clamp assembly for translucent wall panels and the like, provided with overlapping weather seals, and resistant to buckling from differing expansion coefficients of the panel materials.

Another object is to provide a novel panel clamp of more general utility, as well.

Other and further objects will be explained hereinafter and are more particularly delineated in the appended claims. From one of its aspects, the invention embraces a clamp assembly for joining sandwich type panels having longitudinal peripheral portions positioned in edge-to-edge relation and carrying sheets of material on opposed surfaces thereof, said clamp assembly having, in combination, opposed longitudinally extending clamping structures one of which is provided with a longitudinal channel portion extending from the peripheral portion of one of the panels to overlap the adjacent sheet surface of the adjacent panel and to stagger the adjacent panel out of the plane of the said one panel; and the other opposed clamping structure of which has a first portion overlapping the adjacent sheet surface of the said one panel and a second portion overlapping the adjacent sheet surface of the said adjacent panel, with the said first and second portions offset to accomodate for said stagger; recess means provided in each of the overlapping clamp portions for receiving weather-sealing means therein contacting the corresponding overlapped sheet surfaces; and locking means connected with said other clamping structure and extending in the space between the clamping structures for receiving securing means passed from the said one clamping structure into said space to secure the panels together. Preferred details are later explained.

The invention will now be described with reference to the accompanying drawing the single FIGURE of which is a perspective cross sectional view of a preferred embodiment of the invention.

Referring to the drawing, portions of a series of the illustrative translucent sandwich type panels are shown at 1 and 1', in edge-to-edge relation, and comprising a core structure of interlocked longitudinally and transversely extending I-beam elements as described in said Letters Patents, and the peripheral longitudinal elements of which are shown at 2 and 2', carrying opposed resinous planar facing sheets of translucent fiber-reinforced material laminated to the opposite flanged surfaces of the I beams and shown at 4—4' and 6—6' respectively. In accordance with the invention, the right-hand extension portion 4a of the sheet 4 of panel 1 overlaps the left-hand peripheral portion 6a of the sheet 6 of the adjacent panel 1', which is shown terminating flush with the free edge 2a' of the upper peripheral I-beam 2'. While the panels are shown in a particular orientation in the drawing, it is to be understood that this is but by way of illustration; and references to upper and lower and right-hand and left-hand locations are but relative illustrative references.

The upper overlap construction is mechanically effected by the interposition of a longitudinally extending clamp channel strip member 8 to which the sheet extension 4a has been laminated; being fitted to the outer edge and bottom surface of the upper flange of the peripheral I-beam 2 by the lip 8', and secured to a part of the side of the I-beam, as by rivets, by the depending strip extension 8''. The upper structure of this joining clamp 8-8'-8'', which is thus permanently fixed to panel 1, is provided with a recess 10 into which elastic sealant is inserted, preferably extending over most of the overlapped region 6a of the sheet 6 to enable weatherproofing between the panel 1 and the offset or staggered panel 1'.

The lower longitudinal channel segment of the clamp is shown having left-hand and right-hand members sections 12 and 12', respectively, overlapping the bottom right-hand edge portion 4a' of the lower facing sheet 4' of the panel 1, and the bottom left-hand edge portion 6a' of the lower facing sheet 6' of the adjacent panel 1', with both the facing portions 4a' and 6a' being shown terminating flush with the respective lower peripheral longitudinal I-beam flanges 2b and 2b'. The degree of overlap of the lower clamp structure 12-12' is illustrated somewhat less than the length of the overlap at 4a; and weather-sealing foam-tape-receiving recesses 13 and 13' thereof are similarly shown somewhat narrower than the sealant recess 10 of the upper clamp section 8. The left-hand and right-hand lower clamp sections 12 and 12' are intermediately connected by and are directed oppositely from a depending bridge 12'', being offset to accommodate the out-of-plane staggered position of the panels resulting from the upper overlap of the joint assembly.

Upwardly extending from the bridge 12'' is a U-shaped longitudinal locking channel 14, shown extending about a third of the way along the enclosure or space within the clamp and internally longitudinally ridged at 14' to receive, in threaded locking engagement, threaded bolts 16 passed through the channel strip 8 to the right of the lip 8'. Turning the bolt head 16' will thus close and tighten the clamp assembly 8-8'-8'' and 12-12''-12' to lock the panels 1 and 1' together.

As before stated, this clamp construction, as distinguished from the prior integral overlapped channel abutment construction, enables varying expansion and construction effects of different thermally responsive constructional materials, with take-up occuring within the clamp enclosure or space, and in each of longitudinal, transverse and up and down directions—all without buckling or opening the weather-sealed overlap joints.

Variations may be employed as, for example, in the extent of overlap and the geometry of the element 14.

Further modifications will also occur to those skilled in this art, and such are considered to fall within the spirit and scope of the invention as defined in the appended claims.

What is claimed is:

1. An overlapping panel structure comprising, in combination, first and second sandwich type panels having longitudinal peripheral portions positioned in edge-to-edge relation and carrying sheets of material on opposed surfaces thereof, and a clamp assembly, said clamp assembly comprising opposed first and second longitudinally extending clamping structures, the first clamping structure being permanently fixed to the first panel and having a member extending from the peripheral portion of the first panel, said member overlapping an adjacent sheet of the second panel and staggering the second panel out of the plane of the first panel, the second clamping structure having oppositely directed members and being assembled with said panels so that said oppositely directed members overlap adjacent sheets of the first and second panels, respectively, said oppositely directed members being offset to accommodate said staggering of the panels, recesses being provided between each of said members and the sheets overlapped thereby, said recesses receiving weather-sealing means therein contacting the corresponding overlapped sheets, locking means connected with the second clamping structure and extending in the space between the clamping structures, and securing means passed from the first clamping structure into said space, engaging the locking means, and drawing said clamping structures together and clamping said panels therebetween.

2. A panel structure as claimed in claim 1 and in which said member of the first clamping structure is externally laminated to a peripheral extension of the adjacent sheet of said first panel.

3. A panel structure as claimed in claim 2 and in which said panels comprise longitudinal I-beams supporting said opposed sheets and having upper and lower flanges and intermediate beam portions, said member of said first clamping structure having a lip mounted adjacent to a flange of an I-beam of the first panel and having an extension mounted upon the intermediate beam portion of that I-beam.

4. A panel structure as claimed in claim 1 and in which said locking means comprises a longitudinal U-shaped ridged channel.

* * * * *